US006317931B1

(12) United States Patent
Steinert

(10) Patent No.: US 6,317,931 B1
(45) Date of Patent: Nov. 20, 2001

(54) DISTANCE MEASURING DEVICE IN A SPINNING PREPARATION MACHINE

(75) Inventor: Thomas Steinert, Kempen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/575,808

(22) Filed: May 22, 2000

(30) Foreign Application Priority Data

May 21, 1999 (DE) ..... 199 23 420

(51) Int. Cl.[7] ..... D01G 15/02
(52) U.S. Cl. ..... 19/104; 19/103
(58) Field of Search ..... 19/98, 99, 103, 19/104, 105, 108, 110, 112, 113, 114

(56) References Cited

U.S. PATENT DOCUMENTS 5,040,272 8/1991 Fritzsche .
5,398,381 * 3/1995 Schlichter et al. ..... 19/104
5,918,349 * 7/1999 Leifeld et al. ..... 19/103
5,930,869 * 8/1999 Faas et al. ..... 19/98

FOREIGN PATENT DOCUMENTS 0 627 508 12/1994 (EP) .
2 272 458 5/1994 (GB) .

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A fiber processing machine includes a rotary roll provided with a peripheral clothing; a counter element having a part cooperating with the roll clothing; a sensor stationary relative to the counter element and having a sensing portion facing said roll clothing; and an arrangement for generating a signal representing a distance between the sensing portion and the roll clothing. The distance represents a spacing between the roll clothing and the counter element part.

7 Claims, 3 Drawing Sheets

DISTANCE MEASURING DEVICE IN A SPINNING PREPARATION MACHINE

BACKGROUND OF THE INVENTION

This invention relates to a device provided in a fiber processing (spinning preparation) machine, for example, a carding machine, a cleaner or the like for measuring distances between facing surfaces. The machine has a clothed roll which cooperates with a counter element, for example, a closure member and/or a clothed carding element. At least one stationary sensor is provided, and with the counter element a setting arrangement is associated for varying the radial distance between the roll clothing and the counter element.

The distance between the carding cylinder clothing and a facing component is of substantial significance as concerns the carding machine and properties of the fiber. The result of the carding process such as fiber cleaning, nep formation and fiber shortening is largely dependent from the carding gap, that is, the distance between the cylinder clothing and the clothing of the traveling flats or stationary carding elements. The channeling of air about the carding cylinder and heat removal are also dependent from the distance between the cylinder clothing and the clothed or unclothed surfaces, such as mote knife or housing shells. Such clearances are affected by various, partially counteracting factors. A wear of facing clothings leads to an enlargement of the carding gap which, in turn, results in an increase of the nep number and a decrease of the fiber shortening. An increase of the cylinder rpm, for example, for enhancing the cleaning effect, results in an enlargement of the cylinder including its clothing because of the centrifugal forces and thus diminishes the carding gap. Further, when large quantities of fiber or particular types of fiber, for example, chemical fibers are processed, then because of the temperature increase the carding cylinder expands to a greater extent than other, neighboring machine components, resulting in a decrease of the distances of the cylinder clothing from adjoining components.

The carding clearance is affected particularly by the machine settings, on the one hand, and the condition of the clothing, on the other hand. The most important carding clearance of a card equipped with traveling flats is in the principal carding zone, that is, between the carding cylinder and the traveling flats assembly. Of the two clothings which define the carding clearance at least one is in motion (in most cases both are moving). To increase the output of the card, it has been desirable to select the operating rpm, that is, the operating speed of the movable elements, to be as high as permitted by the fiber processing technology. The working clearance is measured in the radial direction (starting from the rotary axis) of the carding cylinder.

In current carding processes increasingly larger fiber quantities per unit time are being handled, requiring higher speeds of the working components. Alone an increase of the fiber flow rate leads, because of the mechanical work, to an increased heat generation even if the working surface areas remain constant. At the same time, however, the technological carding results (uniformity of sliver, degree of cleaning, reduction of neps, etc.), are increasingly improved which requires larger working surfaces participating in the carding process and a closer setting of the components to the carding cylinder. The share of chemical fibers to be processed continuously increases. As compared to cotton, chemical fibers generate more heat due to their frictional contact with the working components of the fiber processing machine. In contemporary designs the working components of high-performance carding machines are enclosed from all sides in order to comply with the stringent safety requirements, to prevent particle emission into the spinning room and to minimize the maintenance requirements of the machines. Grates or even open, material-guiding surfaces which provide for an air exchange, belong to the past.

In view of the above-listed circumstances, the heat input into the fiber processing machine is significantly increased while the extent of heat removal by means of convection has been substantially reduced. The resulting significant heat-up of the high-performance carding machines leads to increased thermo-elastic deformations which, because of the non-uniform distribution of the temperature field, affect the set distances of the working components: the distances decrease between the carding cylinder and the traveling flat bars, the doffer, the stationary flat bars as well as the discharge locations. In an extreme case the set gap between the working components may completely disappear because of heat-caused expansions, so that relatively moving working components collide with one another. This results in significant damaging of the high-performance carding machine. Particularly the generation of heat in the working zone of the carding machine may lead to unlike thermal expansions between the structural components in case of excessive temperature differences.

In practice the quality of the clothing of the flat bar clothings is in regular intervals visually verified by an attendant; a wear results in an increase of the carding gap. In a known device, as disclosed in European patent document 801 158, a sensor is provided with which the working distance of carding clothings, that is, the carding gap may be measured. What is thus measured is the effective distance of the clothing points of one clothing between that of the facing clothing of the machine element. The machine element may have a clothing or may be formed by a housing shell segment having a guide surface. The sensor is conceived particularly for measuring the working distance between the carding cylinder and the flat bars of a traveling flats assembly where an optical device, positioned laterally, senses the carding clearance between the carding cylinder and the flat bar clothings. It is a disadvantage of such an arrangement that the measuring results cannot lead to a conclusion concerning a clearance change in the width direction (that is, parallel to the axis of the carding cylinder). Further, a distance between the sensor and the counter element cannot be measured with such a device.

SUMMARY OF THE INVENTION

It is an object of the invention to provide an improved device of the above-outlined type from which the discussed disadvantages are eliminated and which particularly makes possible to sense distance changes in the width direction and further, which senses in a simple manner only the distance from the carding cylinder clothing and makes possible an optimal setting of such distance.

This object and others to become apparent as the specification progresses, are accomplished by the invention, according to which, briefly stated, a fiber processing machine includes a rotary roll provided with a peripheral clothing; a counter element having a part cooperating with the roll clothing; a sensor stationary relative to the counter element and having a sensing portion facing said roll clothing; and an arrangement for generating a signal representing a distance between the sensing portion and the roll clothing. The distance represents a spacing between the roll clothing and the counter element part.

By the measures according to the invention a wear of the cylinder clothing may be determined, particularly after a longer service period. A distance adjustment results in a change of the effect of the cylinder clothing, either directly with regard to the wear and or indirectly as concerns the clothed or unclothed counter element, particularly the wear of the clothing of a stationary carding element and the heat-caused expansions of the counter element. In this manner, based on a desired value, an optimal setting of the distance between the carding cylinder and the counter element is possible. Distance detection and adjustment may be performed during operation.

The invention has the following additional advantageous features:

- The sensor detects the distance between itself and the points of the cylinder clothing.
- The sensor detects the distance between the counter surface and the points of the cylinder clothing.
- The signals of the sensor are applied as input magnitudes to a control and regulating apparatus for the distance regulation between the counter element and the cylinder clothing.
- The radial distance between the cylinder clothing and the counter element may be settable by the position and/or form of the flexible supporting layer which is arranged between the end portions of the counter element and a stationary substrate face of the machine.
- The counter element is a housing element of the cylinder.
- The cylinder cover is an extruded profiled aluminum component.
- The surface of the counter element oriented towards the carding cylinder has a carding clothing.
- The sensor detects the wear of the cylinder clothing.
- The sensor detects a displacement of the counter element caused by thermal expansion.
- The sensor detects a displacement of the cylinder clothing caused by thermal expansion and/or centrifugal forces.
- The sensor and setting means are connected to an electronic control and regulating apparatus.
- The electronic control and regulating apparatus has a memory for the desired values of the working gaps, and upon exceeding the desired value, a switching operation or display is initiated.
- The setting device for adjusting the working gap is actuated by manual input, for example, by means of a push button.
- At least one parameter relating to the change of the working gap, such as temperature, is measured for producing a measuring value relating to the working gap.
- The position of the flat bar assembly is adjusted as a function of the measuring value for preserving the working gap in accordance with a predetermined value.

DESCRIPTION OF THE PREFERRED EMBODIMENTS

Figure 1:
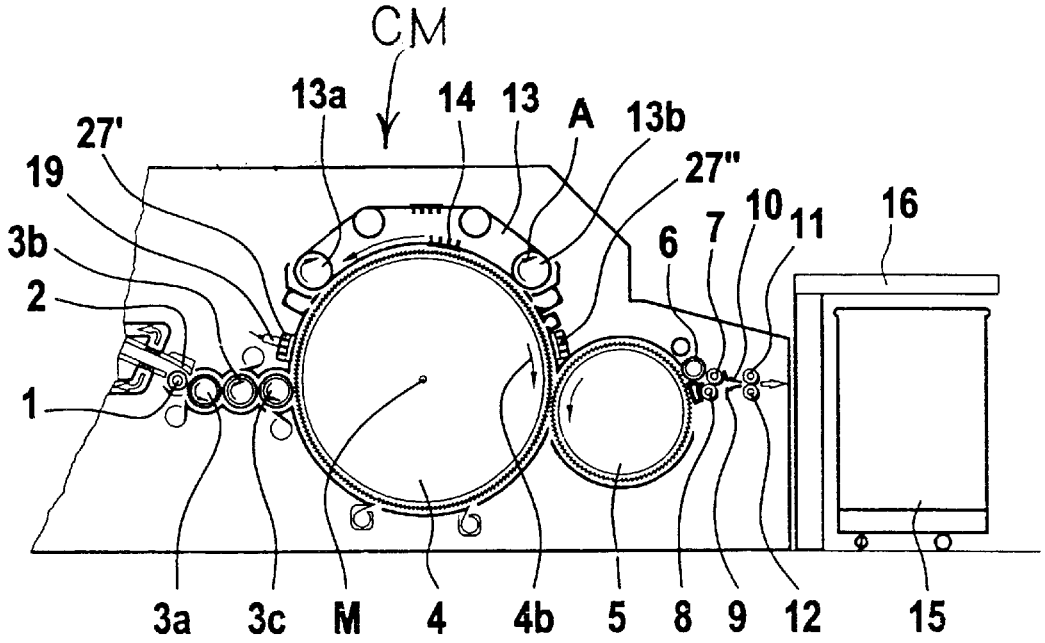
FIG. 1 is schematic side elevational view of a carding machine incorporating the invention.

FIG. 1 shows a carding machine CM which may be, for example, an EXACTACARD DK803 model manufactured by Trützschler GmbH & Co. KG, Mönchengladbach, Germany. The carding machine CM includes a feed roll 1, a feed table 2 cooperating therewith, licker-ins 3*a*, 3*b*, 3*c*, a carding cylinder 4 having a cylinder clothing 4*a*, a direction of rotation 4*b* and a rotary axis M, a doffer 5, a stripping roll 6, crushing rolls 7 and 8, a web guiding element 9, a sliver trumpet 10, calender rolls 11, 12, a traveling flats assembly 13 having traveling flat bars 14, a coiler can 15, a coiling device 16 and the device according to the invention including a sensor 19. The rotary directions of the various roll components of the carding machine are shown by curved arrows drawn therein. A stationary carding segment 27' is positioned between the licker-in 3*c* and the rearward end sprocket 13*a* of the traveling flats assembly 13 whereas the stationary carding segment 27" is situated between the doffer 5 and the frontal end sprocket 13*b* of the traveling flats assembly 13.

Figure 2:
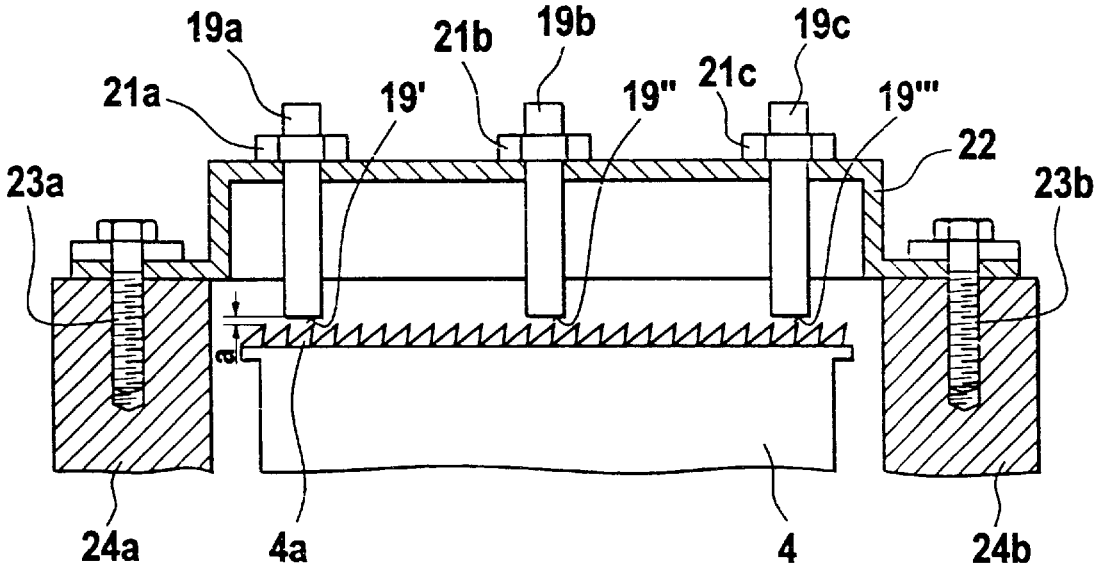
FIG. 2 is a fragmentary sectional schematic front elevational view of the device according to the invention, facing the clothing of the carding cylinder.

Turning to FIG. 2, three sensors 19*a*, 19*b* and 19*c* are arranged which are spaced from one another parallel to the axial length of the carding cylinder 4. The respective sensor surfaces 19', 19" and 19'" are oriented towards the clothing 4*a* of the carding cylinder 4 and are spaced at a distance a therefrom. Fine-threaded adjustment nuts 21*a*, 21*b* and 21*c* provide for a setting of the distance a for each sensor relative to the cylinder clothing 4*a*. The sensors 19*a*, 19*b* and 19*c* are secured in a holding device 22 which is secured stationarily to the lateral shield plates 24*a*, 24*b* by means of respective screws 23*a* and 23*b*.

Figure 3:
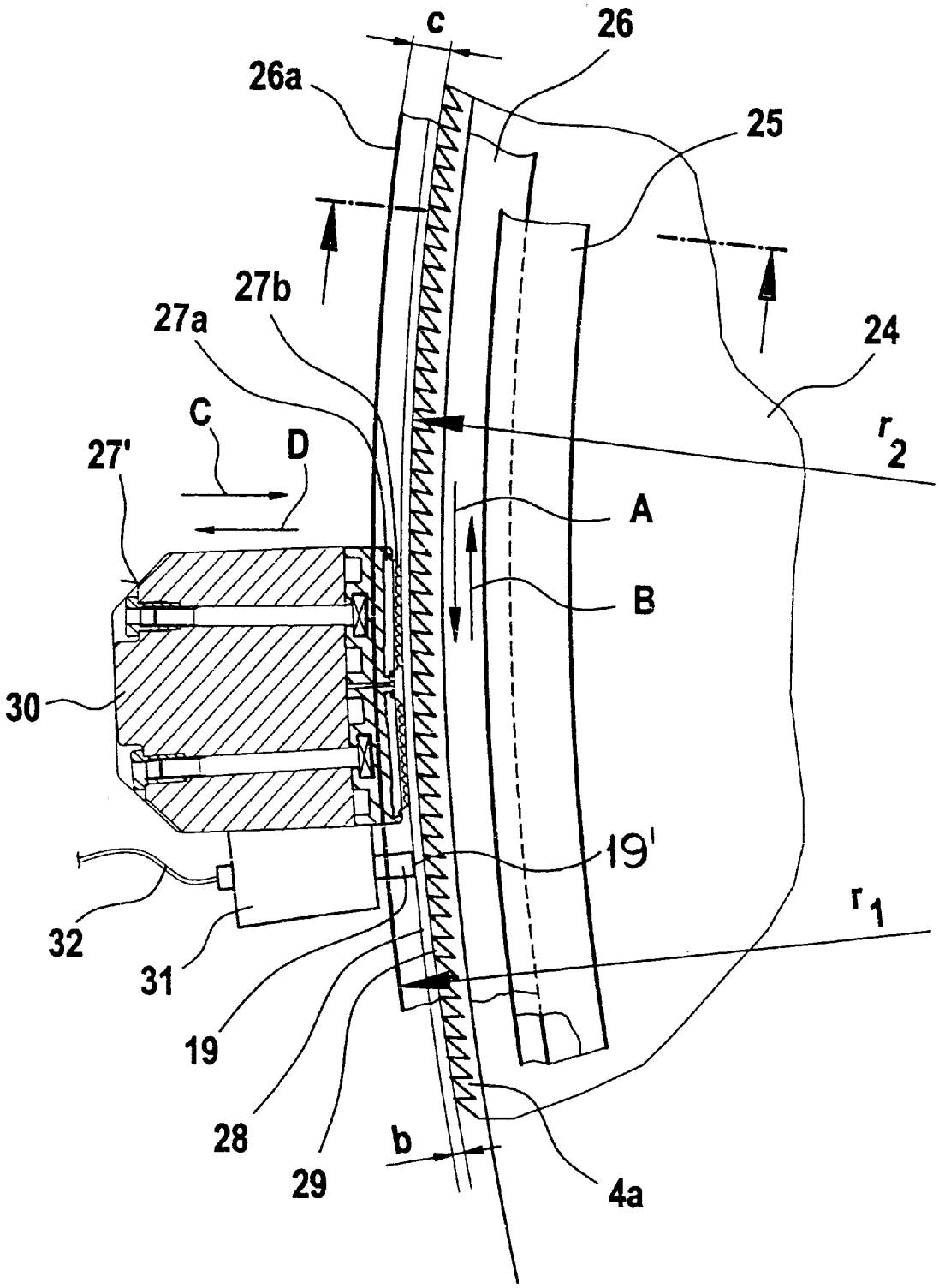
FIG. 3 is a fragmentary sectional side elevational view of a stationary carding element incorporating the invention.

Turning to FIG. 3, a generally semicircular rigid lateral shield plate 24 is secured to the machine frame (not shown) on each side of the carding machine. An arcuate rigid support element 25 is concentrically affixed by casting to the periphery of each shield plate. The support element 25 has an underside and a convex outer face serving as a supporting surface. On the support element 25 a circumferentially wedge-shaped flexible supporting strip 26 is positioned which is made, for example, of a low-friction synthetic material and which has a convex outer surface and a concave inner surface. The concave inner surface lies on the convex surface of the support element 25 in an annular groove thereof and may slide therein in the direction of the arrows A, B. The shifting of the support strip 26 circumferentially in the direction A or B, is, as symbolically illustrated in FIG. 4, effected by a shifting or setting device 35 which includes a driving device such as a motor, a gearing or the like. At opposite axial ends the carding segment 27' is supported on the convex outer face of the support strip 26, so that as the support strip 26 is circumferentially shifted, it displaces radially the carding segment 27' by a camming effect. On the underside of the carding segment 27' carding elements 27*a* are provided, each having a carding clothing 27*b*. The circle on which the points of the clothings 27*b* lie is designated at 28. The circle circumscribable about the points of the clothing 4*a* of the carding cylinder 4 is designated at 29. The distance between the circles 28 and 29 is designated at b and is, for example, 0.20 mm. The distance between the convex outer face 26*a* and the circle 29 is designated at c. The radius of the convex outer face 26*a* is designated at $r_1$ and the radius of the circle 29 is designated at $r_2$. The radii $r_1$ and $r_2$ intersect on the cylinder axis M.

The carding segment 27' includes a carrier 30 which holds the two carding elements 24*a* in series in the rotary direction

4*b* of the carding cylinder 4. The clothings 24*b* of the carding elements 24*a* face the clothing 4*a* of the carding cylinder 4. A holding element 31 carrying the sensor 19 is secured to a vertical end face of the carrier 30.

Figure 4:
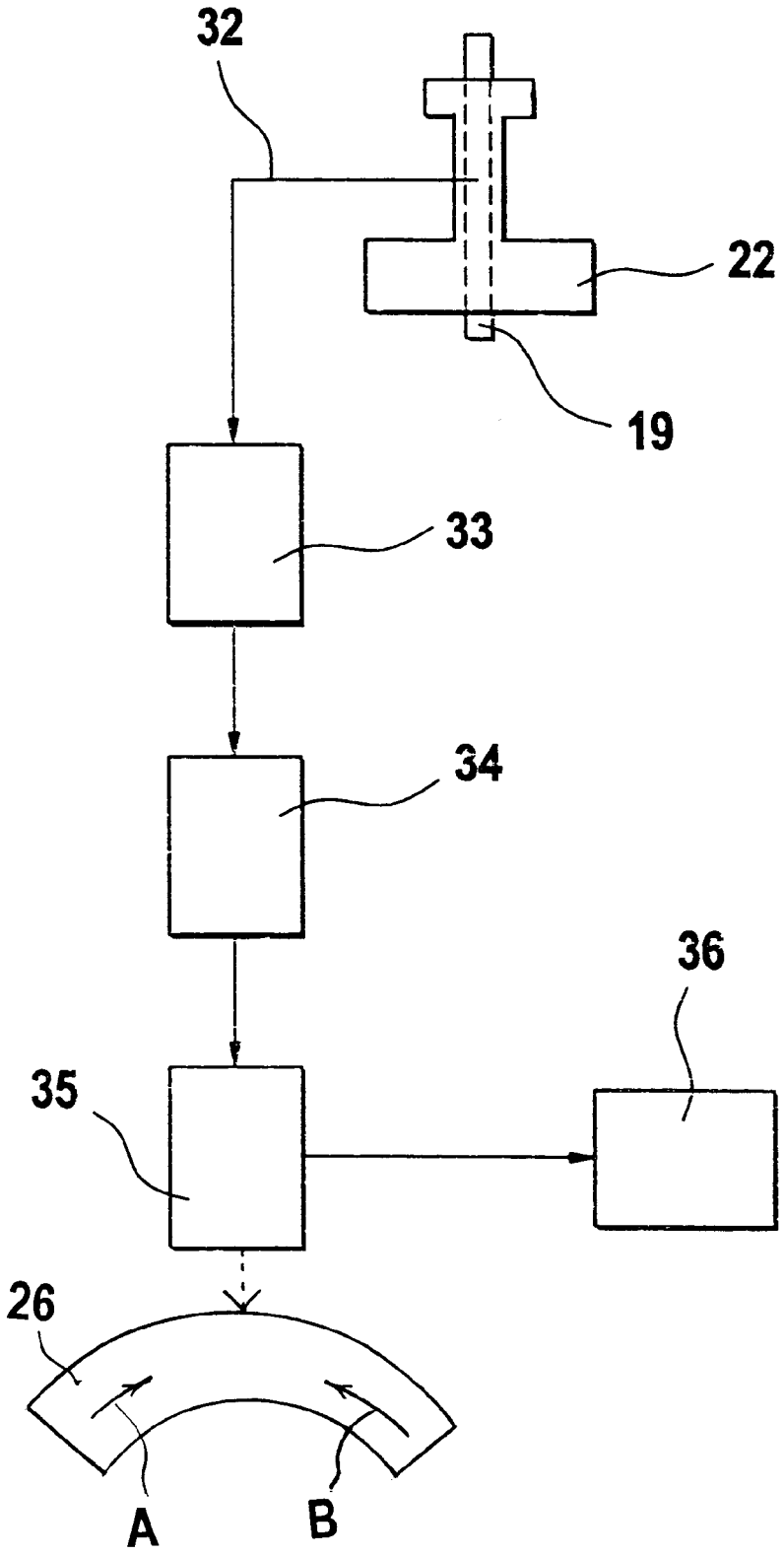
FIG. 4 is a block diagram of a control circuit associated with a distance detecting sensor according to the invention.

Also referring to FIG. 4, in case the distance a between the measuring surface 19' of the sensor 19 and the points 29 of the cylinder clothing 4*a* decreases, for example, because of thermal expansions, or increases because of a wear of the cylinder clothing 4*a*, the sensor emits a signal which is applied by an electric conductor 32 to an electronic evaluating device 33. The electric signal may be utilized for setting or adjusting a given distance b (desired value) by means of an electronic control and regulating apparatus 34. For this purpose, the circumferentially wedge-shaped supporting strip 26 is displaced on the circumferential groove of the support member 25 in the direction A or B. As a result of such a shift the carding segment 27' is displaced in the direction of the arrow C or D. The distance b between the clothings 24*b* of the carding elements 24*a* and the cylinder clothing 4*a* is thus accurately adjustable in a simple manner.

The evaluating device 33 which displays and stores the magnitudes detected by the sensor 19, is connected with the electronic card control device 34 which emits signals for the setting device 35 for shifting the support strip 26 to thus adjust the carding gap (that is, the distance b) between the clothing 24*b* of the carding segment 27' and the clothing 4*a* of the carding cylinder 4. At the same time, this information is also applied to a carding information system which may be a KIT model, manufactured by Trützschler GmbH & Co. KG and which forms part of a computer display device 36 where the data of an entire carding group are monitored.

The invention was described, as an example, in conjunction with the clothings 24*b* of the carding segment 27', cooperating with the clothing 4*a* of the carding cylinder 4. It is to be understood that the invention also encompasses a non-clothed counter element, for example, a circumferential shell plate shrouding the carding cylinder. In case the sensor 19 according to FIG. 3 is secured to the counter element and the distance b from the counter element decreases (for example, because of a thermal expansion), then according to the measures of the invention, by means of measuring the distance a, the distance b is determined.

Structural features relating to mechanisms for adjusting the working distances by means of shifting the support strip 26 as a function of sensor signals are disclosed, for example, in U.S. Pat. No. 5,918,349 which is incorporated herewith by reference.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) a rotary roll provided with a peripheral clothing;

(b) a counter element held stationarily during operation and having a part cooperating with the roll clothing;

(c) a sensor affixed to said counter element and having a sensing portion facing said roll clothing;

(d) means for generating a signal representing a distance between said sensing portion and said roll clothing; said distance representing a spacing between said roll clothing and said part of said counter element;

(e) a control and regulating device connected to said sensor for receiving said signals therefrom; and (f) setting means including a component engaging the stationarily held counter element for displacing said counter element radially with respect to said rotary roll to alter said spacing between said roll clothing and said part of said counter element as a function of said signal.

2. The fiber processing machine as defined in claim 1, wherein said roll clothing has points and further wherein said signal represents a distance between said sensing portion and said points of said roll clothing.

3. The fiber processing machine as defined in claim 1, wherein said counter element is a housing portion covering said rotary roll.

4. The fiber processing machine as defined in claim 1, wherein said counter element has a clothing facing said roll clothing.

5. The fiber processing machine as defined in claim 1, wherein said fiber processing machine is a carding machine and said rotary roll is a main carding cylinder of said carding machine.

6. The fiber processing machine as defined in claim 1, wherein said control and regulating device has a memory for storing data representing desired values of said spacing.

7. The fiber processing machine as defined in claim 1, wherein said component is an elongated, wedge-shaped member shiftable circumferentially relative to said rotary roll; said counter element being in engagement with and being radially displaceable by, said wedge-shaped member by camming effect between said counter element and said wedge shaped member during circumferential shifting motions of said wedge-shaped member.

* * * * *